US012721388B2

(12) United States Patent
Bairen et al.

(10) Patent No.: US 12,721,388 B2
(45) Date of Patent: Sep. 1, 2026

(54) BABY PACIFIER POCKET

(71) Applicant: The North Face Apparel Corp., Wilmington, DE (US)

(72) Inventors: Darcy Bairen, Denver, CO (US); Ellen Trubey, Denver, CO (US); Rebecca Dailey, Denver, CO (US)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 19/288,829

(22) Filed: Aug. 1, 2025

(65) Prior Publication Data

US 2026/0033573 A1 Feb. 5, 2026

Related U.S. Application Data

(60) Provisional application No. 63/678,681, filed on Aug. 2, 2024.

(51) Int. Cl.
*A41D 27/20* (2006.01)
*A41D 11/00* (2006.01)

(52) U.S. Cl.
CPC ..... *A41D 27/207* (2013.01); *A41D 11/00* (2013.01); *A41D 27/204* (2013.01)

(58) Field of Classification Search
CPC ..... A41D 27/207; A41D 11/00; A41D 27/204
USPC ..... 2/80, 83, 86
See application file for complete search history.

(56) References Cited

U.S. PATENT DOCUMENTS

| | | | | | |
|---|---|---|---|---|---|
| 5,131,096 | A * | 7/1992 | Olson | A41D 11/00 | 2/69.5 |
| 5,588,154 | A * | 12/1996 | Blauer | A41D 1/06 | 2/69 |
| 5,669,078 | A * | 9/1997 | Scremin | A41D 27/20 | 2/22 |
| 5,960,471 | A * | 10/1999 | Burton | A41D 1/215 | 2/48 |
| 6,647,552 | B1 * | 11/2003 | Hogan | A41D 13/1245 | 2/114 |
| 12,336,573 | B2 * | 6/2025 | Champlin | A41B 13/06 | |
| 2005/0235391 | A1 * | 10/2005 | Jones | A62B 17/006 | 2/83 |
| 2009/0165206 | A1 * | 7/2009 | Davis | A47G 9/068 | 5/494 |
| 2011/0179547 | A1 * | 7/2011 | Stoneham | A41B 13/005 | 2/83 |
| 2023/0071395 | A1 * | 3/2023 | Fogarty | A63B 21/4009 | |

* cited by examiner

*Primary Examiner* — Gloria M Hale
(74) *Attorney, Agent, or Firm* — Smith, Gambrell & Russell LLP

(57) ABSTRACT

A child's garment may comprise an outer shell. The outer shell may comprise a yoke seam. The outer shell may comprise an aperture at the yoke seam. An area within the aperture may define a pocket configured to accept a pacifier. The outer shell may comprise a tether configured to affix the pacifier to the child's garment. The tether may be configured to affix the pacifier to the child's garment while the pacifier resides in the pocket.

19 Claims, 5 Drawing Sheets

BABY PACIFIER POCKET

CROSS-REFERENCE TO RELATED APPLICATION

This application is a Nonprovisional of provisional patent Application Ser. No. 63/678,681, filed Aug. 2, 2024, which is hereby incorporated by reference in its entirety for any and all purposes.

FIELD OF THE PRESENT DISCLOSURE

The present disclosure relates to a child's garment.

BACKGROUND

Pacifiers are used to soothe infants and young children, particularly when they are tired or agitated. When a pacifier falls out of an infant's mouth, the child often becomes upset and cries. Infants usually lack the ability to find and reinsert the pacifier on their own. Caregivers also struggle to locate and retrieve dropped pacifiers, which can become lost or unsanitary. This common issue requires frequent cleaning of the pacifier, causing frustration for both infants and caregivers.

Therefore, there is a need for a device that keeps the pacifier within easy reach of the infant's mouth and helps the infant find and grasp the pacifier.

SUMMARY OF THE PRESENT DISCLOSURE

The present disclosure relates to a child's garment. The child's garment may comprise an outer shell. The outer shell may comprise a yoke seam. The outer shell may comprise an aperture at the yoke seam. An area within the aperture may define a pocket configured to accept a pacifier.

The outer shell may comprise a tether configured to affix the pacifier to the child's garment.

The tether may be configured to affix the pacifier to the child's garment while the pacifier resides in the pocket.

The tether may be configured to affix the pacifier to the child's garment while the pacifier is in use in a mouth of a wearer.

The aperture may be on an area of the outer shell configured to align with a chest of a wearer.

A majority of the outer shell may comprise a particular material. A portion of the outer shell inside the aperture may comprise a same material as the particular material.

The portion of the outer shell inside the aperture comprising the particular material may comprise an area from the aperture to one inch inside the pocket.

A remaining portion of the outer shell inside the aperture may comprise a different material from the particular material.

The particular material may be intended to be seen and the different material from the particular material may not be intended to be seen.

The pocket may comprise a depth of between 2 inches and 3 inches.

The pocket may comprise a depth of 2.5 inches.

The aperture may comprise a length between 3 inches and 3.5 inches.

The aperture may comprise a length of 3 inches.

The aperture may comprise a length of 3.5 inches.

The present disclosure relates to a method of making the child's garment.

BRIEF DESCRIPTION OF THE DRAWINGS

The present disclosure will be better understood using the description and accompanying schematic figures, which illustrate several non-limiting aspects by way of example. Based on the description and figures, those skilled in the art will be able to deduce other advantageous characteristics of the pocket.

Other advantages of the present disclosure will appear in the light of the description of the execution methods illustrated by the drawings.

DETAILED DESCRIPTION

Figure 1:
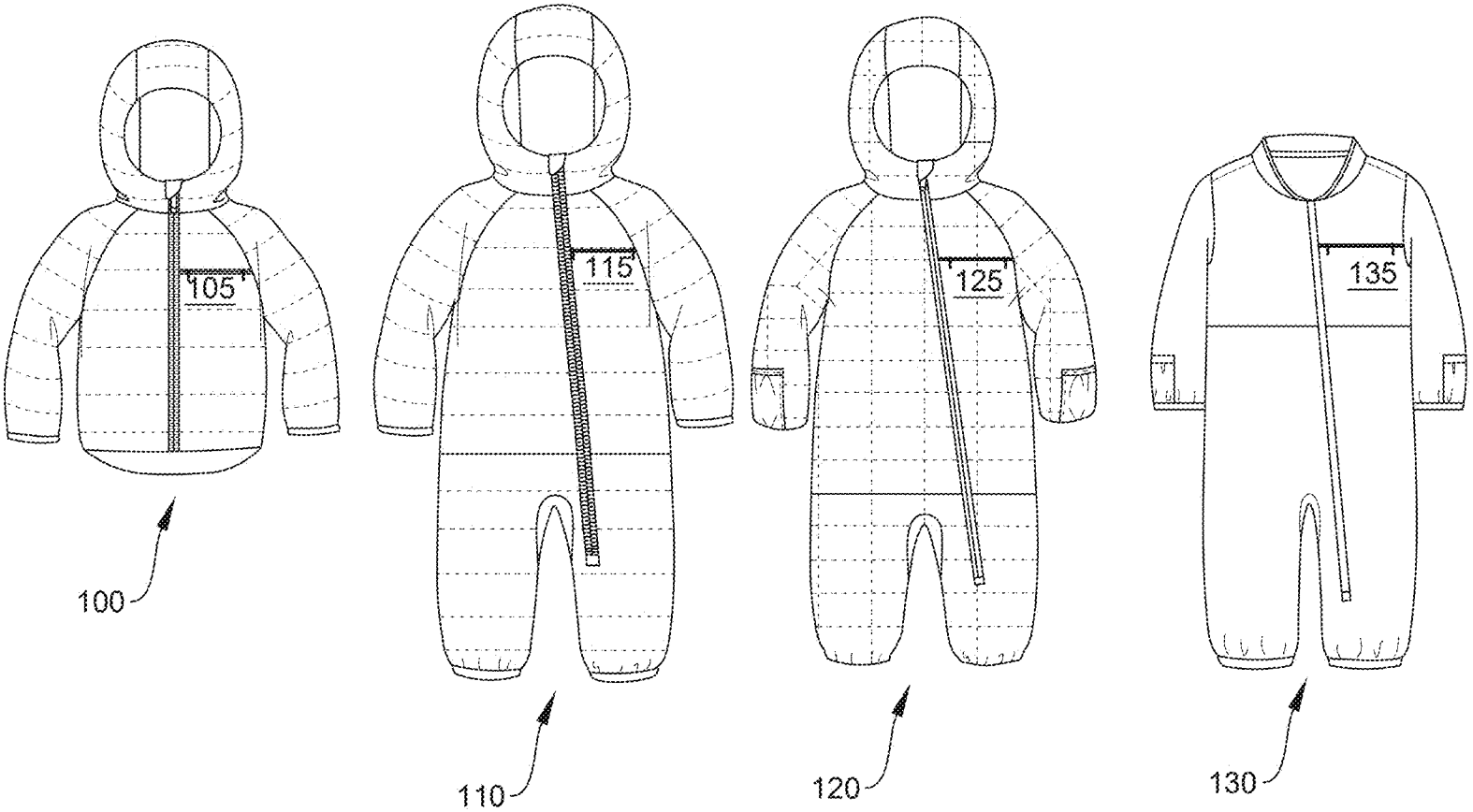
FIG. 1 shows example garments according to the present disclosure.

FIG. 1 shows example children's garments according to the present disclosure. A first child's garment 100 may comprise an upper body cover. The first child's garment 100 may comprise a removable head covering. The first child's garment 100 may be reversible. The first child's garment 100 may be shown in a first configuration. In the first configuration, the first child's garment 100 may comprise an outer shell and an inner shell. The outer shell may comprise a first pacifier pocket 105. In a second configuration the first child's garment 100 may be reversed from the first configuration. In the second configuration, the outer shell in the first configuration may become an inner shell and the inner shell from the first configuration may become an outer shell. The inner shell may comprise a second pacifier pocket for use when the first child's garment 100 is in the second configuration. The first pacifier pocket 105 may comprise a half-dome shape.

The first child's garment 100 may comprise a yoke seam. An aperture associated with the first pacifier pocket 105 may be on the yoke seam. The first pacifier pocket 105 may comprise a depth of between 2 inches and 3 inches. The first pacifier pocket 105 may comprise a depth of 2.5 inches. The aperture may comprise a length between 3 inches and 3.5 inches. The aperture may comprise a length of 3 inches. The aperture may comprise a length of 3.5 inches. The first pacifier pocket 105 may be on a front left portion of the first child's garment 100. The first pacifier pocket 105 may be configured to be at a chest area of a wearer when the first child's garment 100 is worn. The second pacifier pocket may be similar to the first pacifier pocket 105.

The first child's garment 100 may comprise baffles. Each of the baffles may run parallel to the ground when the first child's garment 100 is worn as intended and be configured to retain insulation. The first pacifier pocket 105 may extend through multiple baffles, wherein each of the multiple baffles may connect to a fabric associated with an inner layer of the first pacifier pocket 105 but not to a fabric associated with an outer layer of the first pacifier pocket 105. The aperture associated with the first pacified pocket 105 may be at or near a location of a stitch associated with a baffle.

The first child's garment 100 may comprise a tether. A first end of the tether may be affixed to the first child's garment 100. The first end of the tether may be incorporated into an outer shell of the first child's garment 100. The first end of the tether may comprise a component configured to interface with the first child's garment 100 or a component on the first child's garment 100. A second end of the tether may be configured to accept a pacifier. The second end of the tether may comprise a component configured to interface with the pacifier. The tether may be removable. The tether may be attachable to the outer shell of the first configuration of the first child's garment 100. The tether may be attachable to the outer shell of the outer shell of the second configuration of the first child's garment 100. A first tether may be attached to the outer shell in the first configuration of the first child's garment 100. A second tether may be attached to the outer shell in the second configuration of the first child's garment 100. The tether (the removable tether or the first tether) may be configured to allow a pacifier to reside in the first pacifier pocket 105 and allow the pacifier to reside in a mouth of a wearer of the first child's garment 100 when the first child's garment 100 is in the first configuration. The tether (the removable tether or the second tether) may be configured to allow a pacifier to reside in the second pacifier pocket and allow the pacifier to reside in the mouth of the wearer of the first child's garment 100 when the first child's garment 100 is in the second configuration.

A second child's garment 110 may comprise a onesie. The second child's garment 110 may comprise a removable head covering. The second child's garment 110 may be reversible. The second child's garment 110 may be shown in a first configuration. In the first configuration, the second child's garment 110 may comprise an outer shell and an inner shell. The outer shell may comprise a first pacifier pocket 115. In a second configuration the second child's garment 110 may be reversed from the first configuration. In the second configuration, the outer shell in the first configuration may become an inner shell and the inner shell from the first configuration may become an outer shell. The inner shell may comprise a second pacifier pocket for use when the second child's garment 110 is in the second configuration. The second pacifier pocket may be similar to the first pacifier pocket. The first pacifier pocket 115 of the second child's garment 110 may be similar to the first pacifier pocket 105 of the first child's garment 100 described above. The second child's garment 110 may comprise one or more tethers. The one or more tethers of the second child's garment 110 may be similar to the one or more tethers of the first child's garment 100 described above.

The second child's garment 110 may comprise baffles. Each of the baffles may run parallel to the ground when the second child's garment 110 is worn as intended and be configured to retain insulation. The first pacifier pocket 115 may extend through multiple baffles, wherein each of the multiple baffles may connect to a fabric associated with an inner layer of the first pacifier pocket 115 but not to a fabric associated with an outer layer of the first pacifier pocket 115. The aperture associated with the first pacified pocket 115 may be at or near a location of a stitch associated with a baffle. The first pacifier pocket 115 may comprise a half-dome shape.

A third child's garment 120 may comprise a onesie. The third child's garment 120 may comprise a removable head covering. The third child's garment 120 may have an outer shell. The outer shell may comprise a pacifier pocket 125. The pacifier pocket 125 may be similar to the first pacifier pocket 105 of the first child's garment 100 described above. The third child's garment 120 may comprise one or more tethers. The one or more tethers of the third child's garment 120 may be similar to the one or more tethers of the first child's garment 100 described above.

The third child's garment 120 may comprise baffles. Each of the baffles may run parallel or perpendicular to the ground, creating rectangular sections, when the third child's garment 120 is worn as intended and be configured to retain insulation. The first pacifier pocket 125 may extend through multiple baffles, wherein each of the multiple baffles may connect to a fabric associated with an inner layer of the first pacifier pocket 125 but not to a fabric associated with an outer layer of the first pacifier pocket 125. The aperture associated with the first pacified pocket 125 may be at or near a location of a stitch associated with one or more baffles. The first pacifier pocket 125 may comprise a half-dome shape.

A fourth child's garment 130 may comprise a onesie. The fourth child's garment 130 may have an outer shell. The outer shell may comprise a pacifier pocket 135. The pacifier pocket 135 may be similar to the first pacifier pocket 105 of the first child's garment 100 described above. The fourth child's garment 130 may comprise one or more tethers. The one or more tethers of the fourth child's garment 130 may be similar to the one or more tethers of the first child's garment 100 described above.

As an illustrative example, one or more of the pockets described herein may be accessed via an exterior or interior of the respective garment. As described for reversible garments, one or more of the pockets described herein may be accessed from the first configuration or the second configuration. As a further example, one or more of the garments described herein may include additional layers, for example, insulative layers, coatings, waterproofing, and the like. The garments described herein are for illustration and not intended to limit the applicability of the constructions on other materials, garments, or equipment such as a outwear or insulative clothing.

Figure 2:
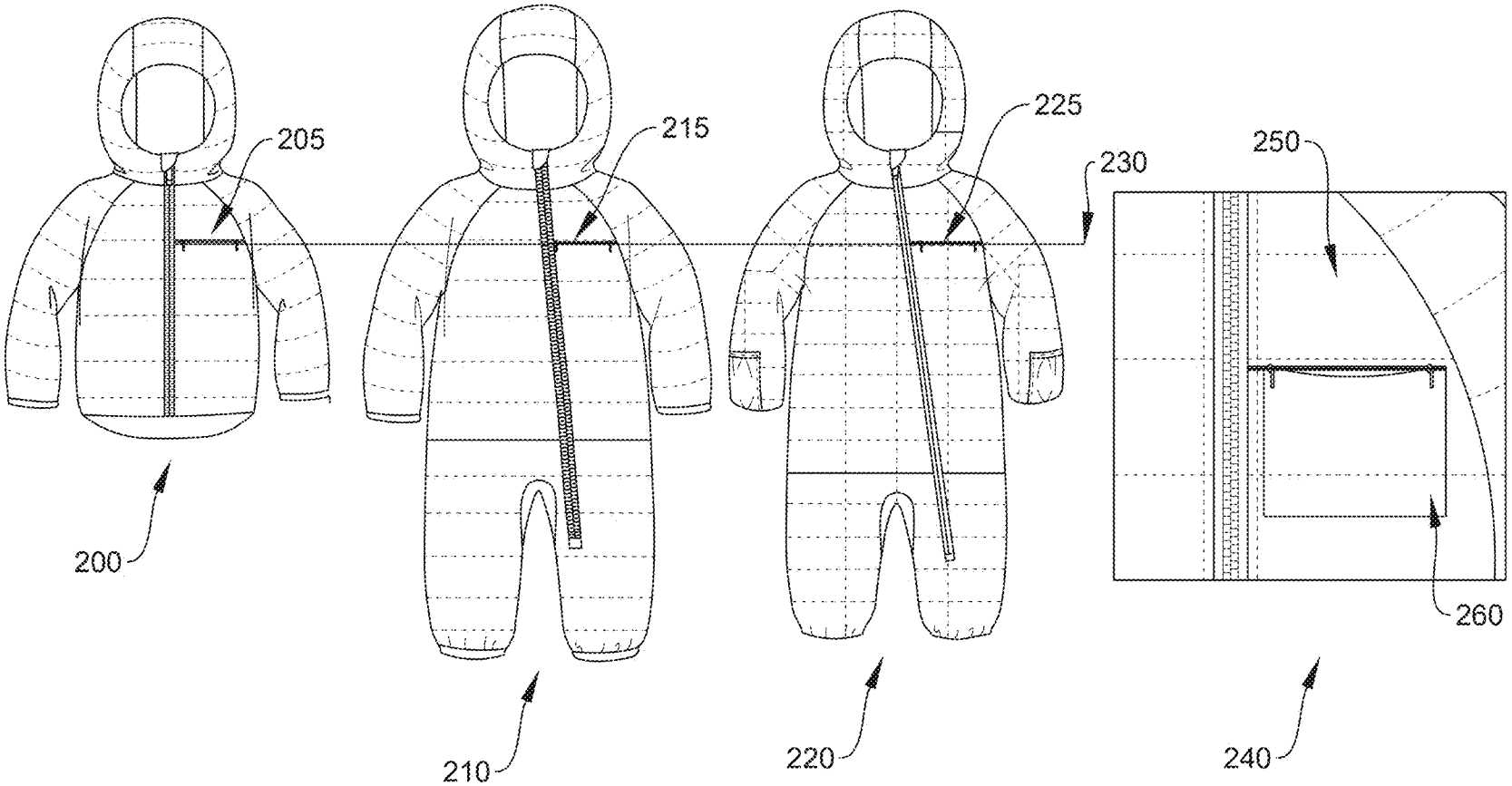
FIG. 2 shows example garments according to the present disclosure and an example pocket according to the present disclosure.

FIG. 2 shows example garments according to the present disclosure and an example pocket according to the present disclosure. FIG. 2 shows a first child's garment 200, a second child's garment 210, and a third child's garment 220. The first child's garment 200 of FIG. 2 may be the same as or similar to the first child's garment 100 of FIG. 1. The second child's garment 210 of FIG. 2 may be the same as or similar to the second child's garment 110 of FIG. 1. The third child's garment 220 of FIG. 2 may be the same as or similar to the third child's garment 120 of FIG. 1. The first child's garment 200 may comprise a first pacifier pocket 205, which may be the same as or similar to the first pacifier 105 in FIG. 1. As explained above, the first child's garment 200 may comprise a second pacifier pocket in a similar position to the first pacifier pocket 205 when the first child's garment 200 is in a reversed state. The second child's garment 210 may comprise a first pacifier pocket 215, which may be the same as or similar to the first pacifier 115 in FIG. 1. As explained above, the second child's garment 210 may comprise a second pacifier pocket in a similar position to the first pacifier pocket 215 when the second child's garment 210 is in a reversed state. The third child's garment 220 may comprise a pacifier pocket 225, which may be the same as or similar to the pacifier pocket 125 in FIG. 1.

An imaginary line 230 illustrates a location where a yoke seam might be on the first child's garment 200, the second child's garment 210, and the third child's garment 220. As shown, an aperture associated with the first pacifier pocket 205 may align with the imaginary line 230 on the first child's garment 200, and therefore the yoke seam of the first child's garment 200; an aperture associated with the first pacifier pocket 215 may align with the imaginary line 230 on the second child's garment 210, and therefore the yoke seam of the second child's garment 210; and an aperture associated with the third pacifier pocket 225 may align with the imaginary line 230 on the third child's garment 220, and therefore the yoke seam of the third child's garment 220. An aperture associated with the second pacifier pocket of the first child's garment 200 may align with the yoke seam of the first child's garment 200. An aperture associated with the second pacifier pocket of the second child's garment 210 may align with the yoke seam of the second child's garment 210.

Similarly, the imaginary line 230 illustrates a location where a stitch associated with a baffle might be on the first child's garment 200, the second child's garment 210, and the third child's garment 220. As shown, an aperture associated with the first pacifier pocket 205 may align with the imaginary line 230 on the first child's garment 200, and a stitch associated with a baffle of the first child's garment 200; an aperture associated with the first pacifier pocket 215 may align with the imaginary line 230 on the second child's garment 210, and a stitch associated with a baffle of the second child's garment 210; and an aperture associated with the third pacifier pocket 225 may align with the imaginary line 230 on the third child's garment 220, and a stitch associated with a baffle of the third child's garment 220. An aperture associated with the second pacifier pocket of the first child's garment 200 may align with a stitch associated with a baffle of the first child's garment 200. An aperture associated with the second pacifier pocket of the second child's garment 210 may align with a stitch associated with a baffle of the second child's garment 210.

A box 240 may show a close-up view of a pocket, such as any of the pockets previously mentioned, such as the first pacifier pocket 105 or the second pacifier pocket of the first child's garment 100 of FIG. 1, the first pacifier pocket 115 or the second pacifier pocket of the second child's garment 110 of FIG. 1, the pacifier pocket 125 of the third child's garment 120 of FIG. 1, the pacifier pocket 135 of the fourth child's garment 130 of FIG. 1, the first pacifier pocket 205 or the second pacifier pocket of the first child's garment 200, the first pacifier pocket 215 or the second pacifier pocket of the second child's garment 210, and the pacifier pocket 225 of the third child's garment 220. The particular children's garments shown are presented for illustration purposes only and not meant to be limiting. The pacifier pocket system described herein could be applied to a variety of children's garments. The box 240 may show an area 250 above the pacifier pocket may comprise an image, such as a logo or branding. The box 240 may show an x-ray view of a pocket bag 260. Alternate x-ray views of pocket bags will be described with reference to FIGS. 3 and 4.

Figure 3:
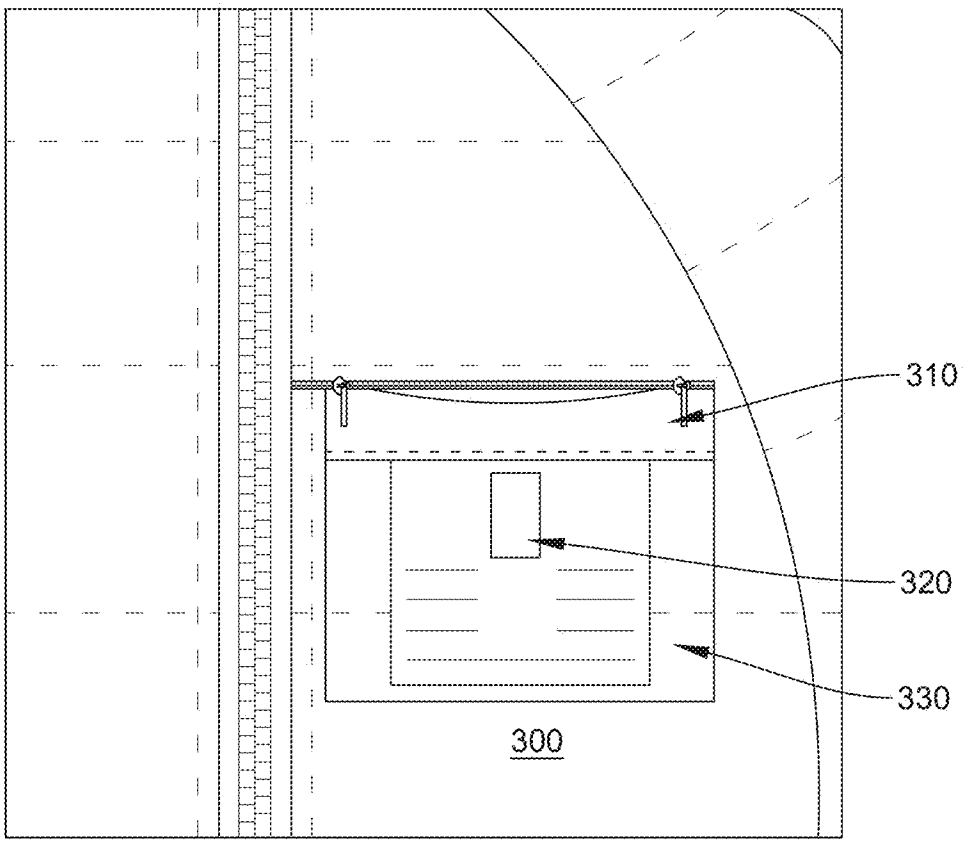
FIG. 3 shows an example pocket according to the present disclosure.

FIG. 3 shows an example x-ray view of a pocket 300 according to the present disclosure. As shown, the pocket 300 may comprise an aperture on a seam. The pocket 300 may comprise bar tacks at the aperture. The bar tacks at the aperture are shown as being 3.5 inches apart, although other values appropriate for receiving a pacifier, such as 3 inches, for example, may be used. The pocket 300 is shown as being 2.5 inches deep, although other values appropriate for receiving a pacifier, such as 3 inches, for example, may be used. The pocket 300 may comprise a patch 310. The patch 310 may extend from the aperture downwards. The patch 310 may extend down from the aperture a set distance, such as one inch, for example. Optionally, an image 320, such as a logo or branding, may be placed on the front of the pocket 300. Optionally, a label 330 may be placed inside the pocket 300. The label may comprise information about an associated garment. The label may comprise, an image, such as the image 320.

Figure 4:
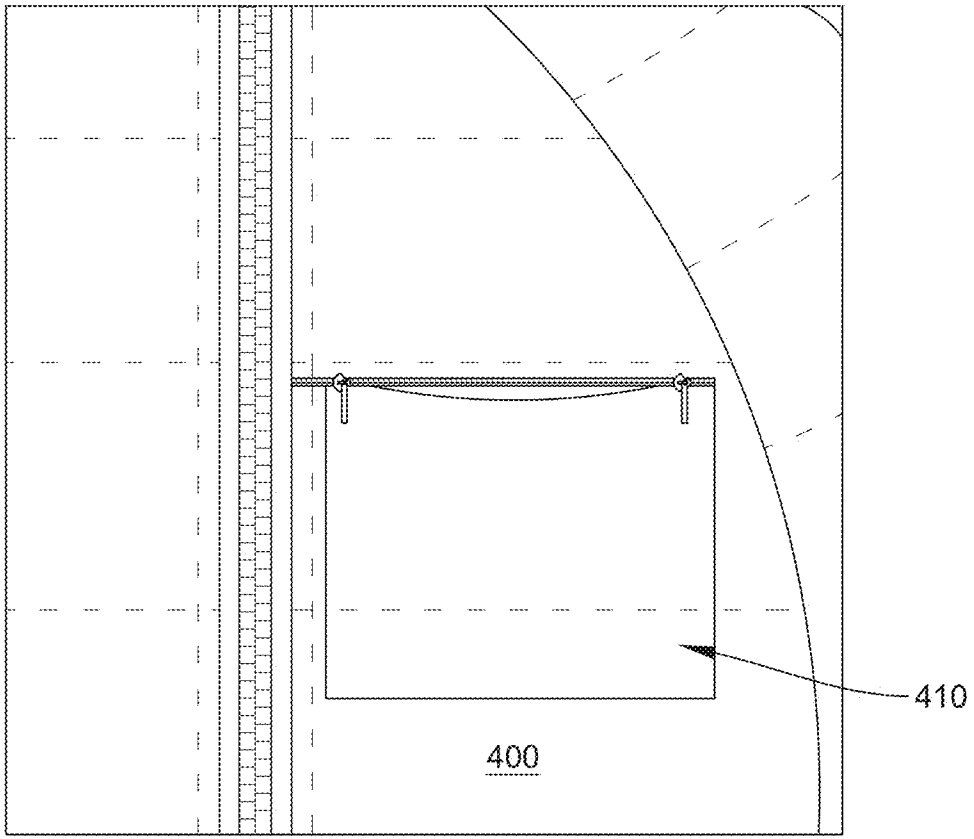
FIG. 4 shows an example pocket according to the present disclosure.

FIG. 4 shows an example x-ray view 410 of a pocket 400 according to the present disclosure. As shown, the pocket 400 may comprise an aperture on a seam. The pocket 400 may comprise bar tacks at the aperture. The bar tacks at the aperture are shown as being 3 inches apart, although other values appropriate for receiving a pacifier, such as 3.5 inches, for example, may be used. The pocket 400 is shown as being 2.5 inches deep, although other values appropriate for receiving a pacifier, such as 3 inches, for example, may be used.

Figure 5:
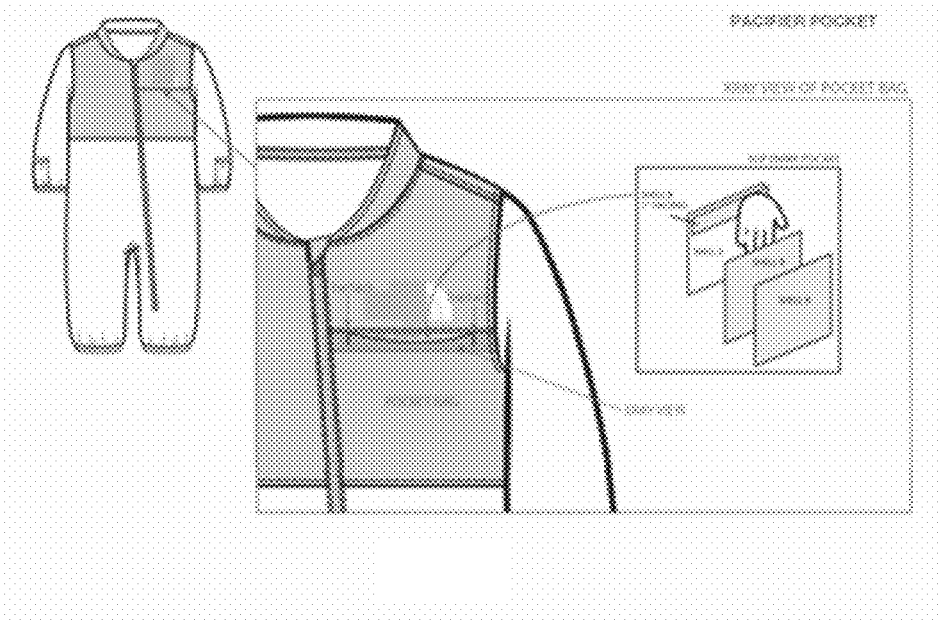
FIG. 5 shows an example pocket according to the present disclosure.

As shown in FIG. 5, the pacifier pocket may comprise an aperture between two bar tacks. The pacifier pocket may comprise the aperture on a yoke seam. As shown, a pacifier pocket as described herein may comprise two shells, Shell A and Shell B. Shell B may comprise a material configured to be outward facing. Shell A may comprise a cheaper material than Shell B. An outward facing portion of the pacifier pocket may comprise Shell B. A majority of an inner portion of the pacifier pocket may comprise Shell A. An area of the inner portion of the pacifier pocket from the aperture to some depth, such as one inch, for example, may comprise Shell B.

Figure 6:
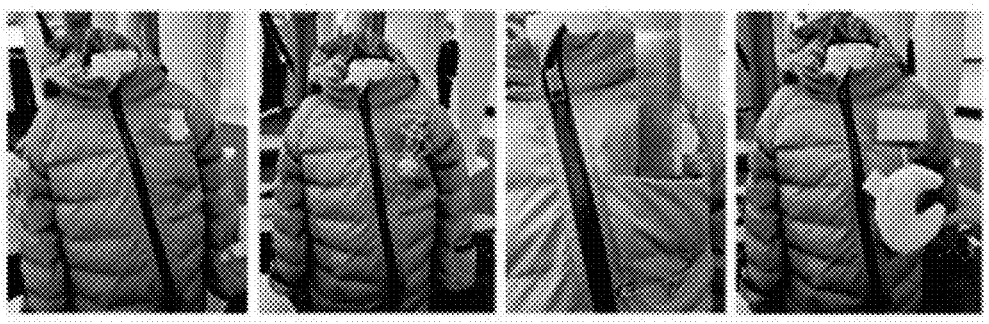
FIG. 6 shows an example pocket according to the present disclosure.

FIG. 6 shows various examples of child's garments with one or more pacifier pockets. As shown, a pacifier pocket as described herein may receive a pacifier, even if the pacifier is attached to another device, such as clip or stuffed device.

Although the present disclosure has been described in particular with respect to preferred aspects, it is obvious to those skilled in the craft that these aspects as described in the figures and in the description are not limiting in nature. It is clear to those skilled in the craft that variations other than those described and shown may be contemplated without departing from the scope of the present disclosure as defined in the claims.

Example Clause 1: An article of clothing configured in shape and size to be worn by a child, the article comprising: an outer shell material comprising a yoke seam; an inner material disposed adjacent at least a portion of the outer shell material, wherein a space between the inner material and the outer shell material defines a pocket; an aperture formed at or adjacent the yoke seam, wherein the aperture is configured to allow access into the pocket; and a tether coupled to one or more of the inner material and the outer shell material at or adjacent the pocket, the tether configured to be selectively coupled to a pacifier.

Example Clause 2: The article of Example Clause 1, wherein the tether is coupled to one or more of the inner material and the outer shell material at a connection point disposed inside the pocket.

Example Clause 3: The article of Example Clause 1 or Example Clause 2, wherein the tether is configured to be coupled to the pacifier while the pacifier is in a mouth of a wearer.

Example Clause 4: The article of any one of Example Clauses 1-3, wherein the aperture is on an area of an outer shell configured to align with a chest of a wearer.

Example Clause 5: The article of any one of Example Clauses 1-4, wherein the outer shell material comprises a first material and the inner material comprises a second material different from the first material.

Example Clause 6: The article of any one of Example Clauses 1-5, and at least a portion of the inner material comprises or is covered with the first material.

Example Clause 7: The article of any one of Example Clauses 1-6, wherein the pocket comprises a depth of between 2 inches and 3 inches.

Example Clause 8: The article of any one of Example Clauses 1-7, wherein the pocket comprises a depth of about 2_prd_5 inches.

Example Clause 9: The article of any one of Example Clauses 1-8, wherein the aperture comprises a length between 3 inches and 3_prd_5 inches.

Example Clause 10: The article of any one of Example Clauses 1-9, wherein the aperture comprises a length of about 3 inches.

Example Clause 11: The article of any one of Example Clauses 1-10, wherein the aperture comprises a length of about 3_prd_5 inches.

Example Clause 12: The article of any one of Example Clauses 1-11, wherein the pocket comprises a semi-dome shape.

Example Clause 13: The article of any one of Example Clauses 1-12, further comprising: an outer shell comprising the outer shell material; an inner lining comprising the inner material; and a plurality of baffles defined between the inner lining and the outer shell, the plurality of baffles configured to retain an insulating material.

Example Clause 14: The article of any one of Example Clauses 1-13, wherein the pocket covers a portion of at least one stitch associated with at least one baffle of the plurality of baffles.

Example Clause 15: The article of any one of Example Clauses 1-14, wherein the aperture is at or adjacent at least one stitch associated with at least one baffle of the plurality of baffles.

Example Clause 16: A method of making the article of claim 1.

Example Clause 17: An article of clothing comprising: an outer shell material comprising a yoke seam; an inner material disposed adjacent at least a portion of the outer shell material, wherein a space between the inner material and the outer shell material defines a pocket; an aperture formed at or adjacent the yoke seam, wherein the aperture is configured to allow access into the pocket; and a tether coupled to one or more of the inner material and the outer shell material at or adjacent the pocket.

Example Clause 18: The article of Example Clause 17, further comprising: an outer shell comprising the outer shell material; an inner lining comprising the inner material; and a plurality of baffles defined between the inner lining and the outer shell, the plurality of baffles configured to retain an insulating material.

Example Clause 19: The article of Example Clause 17 or Example Clause 18, wherein the pocket comprises a semi-dome shape.

Example Clause 20: An article of clothing configured in shape and size to be worn by a child, the article comprising: an outer shell material comprising a yoke seam; an inner material disposed adjacent the outer shell material; a plurality of baffles defined between the inner material and the out shell material, the plurality of baffles configured to retain an insulating material; a pocket defined between at least a portion of the inner material adjacent a first portion of the outer shell material, wherein the at least the portion of the inner material covered by a second portion of the outer shell material, and wherein the second portion of the outer shell material covers at least one portion of at least one baffle; an aperture formed at or adjacent the yoke seam, wherein the aperture is configured to allow access into the pocket; and a tether coupled to one or more of the inner material and the outer shell material at or adjacent the pocket, the tether configured to be selectively coupled to a pacifier.

What is claimed is:

1. An article of clothing configured in shape and size to be worn by a child, the article comprising:

an outer shell material comprising a yoke seam;

an inner material disposed adjacent at least a portion of the outer shell material, wherein a space between the inner material and the outer shell material defines a pocket;

an aperture formed at or adjacent the yoke seam, wherein the aperture is configured to allow access into the pocket; and a tether coupled to one or more of the inner material and the outer shell material at or adjacent the pocket, the tether configured to be selectively coupled to a pacifier.

2. The article of claim 1, wherein the tether is coupled to one or more of the inner material and the outer shell material at a connection point disposed inside the pocket.

3. The article of claim 1, wherein the tether is configured to be coupled to the pacifier while the pacifier is in a mouth of a wearer.

4. The article of claim 1, wherein the aperture is on an area of an outer shell configured to align with a chest of a wearer.

5. The article of claim 1, wherein the outer shell material comprises a first material and the inner material comprises a second material different from the first material.

6. The article of claim 5, and at least a portion of the inner material comprises or is covered with the first material.

7. The article of claim 1, wherein the pocket comprises a depth of between 2 inches and 3 inches.

8. The article of claim 1, wherein the pocket comprises a depth of about 2.5 inches.

9. The article of claim 1, wherein the aperture comprises a length between 3 inches and 3.5 inches.

10. The article of claim 1, wherein the aperture comprises a length of about 3 inches.

11. The article of claim 1, wherein the aperture comprises a length of about 3.5 inches.

12. The article of claim 1, wherein the pocket comprises a semi-dome shape.

13. The article of claim 1, further comprising:

an outer shell comprising the outer shell material;

an inner lining comprising the inner material; and a plurality of baffles defined between the inner lining and the outer shell, the plurality of baffles configured to retain an insulating material.

14. The article of claim 13, wherein the pocket covers a portion of at least one stitch associated with at least one baffle of the plurality of baffles.

15. The article of claim 13, wherein the aperture is at or adjacent at least one stitch associated with at least one baffle of the plurality of baffles.

16. An article of clothing comprising:

an outer shell material comprising a yoke seam;

an inner material disposed adjacent at least a portion of the outer shell material, wherein a space between the inner material and the outer shell material defines a pocket;

an aperture formed at or adjacent the yoke seam, wherein the aperture is configured to allow access into the pocket; and a tether coupled to one or more of the inner material and the outer shell material at or adjacent the pocket.

17. The article of claim 16, further comprising:

an outer shell comprising the outer shell material;

an inner lining comprising the inner material; and a plurality of baffles defined between the inner lining and the outer shell, the plurality of baffles configured to retain an insulating material.

18. The article of claim 16, wherein the pocket comprises a semi-dome shape.

19. An article of clothing configured in shape and size to be worn by a child, the article comprising:

an outer shell material comprising a yoke seam;

an inner material disposed adjacent the outer shell material;

a plurality of baffles defined between the inner material and the outer shell material, the plurality of baffles configured to retain an insulating material;

a pocket defined between at least a portion of the inner material adjacent a first portion of the outer shell material, wherein the at least the portion of the inner material covered by a second portion of the outer shell material, wherein the second portion of the outer shell material covers at least one portion of at least one baffle, and wherein the pocket covers a portion of at least one stitch associated with at least one baffle of the plurality of baffles;

an aperture formed at or adjacent the yoke seam and at or adjacent the at least one stitch, wherein the aperture is configured to allow access into the pocket; and a tether coupled to one or more of the inner material and the outer shell material at or adjacent the pocket, the tether configured to be selectively coupled to a pacifier.

* * * * *